United States Patent [19]

Crotti

[11] 4,294,040

[45] Oct. 13, 1981

[54] SAFETY DOOR FOR BUILDINGS AND ROOMS

[76] Inventor: Bianca M. Crotti, Via Archirola, 125, Modena, Italy

[21] Appl. No.: 80,921

[22] Filed: Oct. 1, 1979

[30] Foreign Application Priority Data

Sep. 29, 1978 [IT] Italy ..... 40125 A/78

[51] Int. Cl.[3] ..... E05D 15/58

[52] U.S. Cl. ..... 49/254; 49/257; 49/260; 49/449; 109/70

[58] Field of Search ..... 49/254, 257–260, 49/176, 177, 449; 109/69, 70, 64, 74, 75; 16/179

[56] References Cited

U.S. PATENT DOCUMENTS 915,397 3/1909 Weiss ..... 109/70
4,063,389 12/1977 Leder ..... 49/449 X

FOREIGN PATENT DOCUMENTS 705897 4/1941 Fed. Rep. of Germany .
7119534 1/1973 France .
454415 6/1968 Switzerland .

*Primary Examiner*—Kenneth Downey
*Attorney, Agent, or Firm*—Browdy and Neimark

[57] ABSTRACT

A safety door for buildings and rooms included two main sliding parts, a supporting column equipped with hinges and a door body supported by the hinges. The supporting column enters a first cavity with the fixed works (wall) at the side of the hinges during opening, the hinges remaining outside this cavity. The edge of the door opposite to that one which has the hinges thereon enters a second cavity in the fixed works (wall) opposite the first cavity during closing. A lock is installed in the main body of the door, this lock also entering the second cavity, only its keyhole or control member being accessible from the inside or outside, the accessibility being effected via slits in the fixed works (wall). The rest of the door is surrounded by a continuous frame lining the walls of the cavities.

13 Claims, 14 Drawing Figures

SAFETY DOOR FOR BUILDINGS AND ROOMS

BACKGROUND OF THE INVENTION

The invention concerns a safety door for buildings and rooms in general, that is to say, a door for residential houses, for buildings destined to any use whatsoever, for the closing of rooms destined to protect goods and values and for rooms in general being part of a real estate or not.

The prior state of art is characterized by doors supported by hinges fixed to the wall or to a frame placed between the wall and the door panel itself. Doors of this type can be opened by introducing the key into the lock in the door panel or by properly manipulating a combination lock and them simply rotating the door body around the hinges. With the above types of doors the panels can be forced or lifted from the hinges using levers notwithstanding the reinforcement of even armourplating of the panels and a great number of latches, and the locks can be forced out of their seating (and therefore be made inefficacious) by forcing them from the outside by means of a tool suitable to exert the necessary thrust; or the locks can be removed from the inside by simply dismounting them, which can be done by those, who might have entered the room by a window or in some other way. All of this occurs particularly but not exclusively often with the doors of residential houses, offices, factories, storehouses and shops. This prior state of art is ripe for further improvements, having the aim to provide safety doors, which cannot be forced from the outside by levers and the locks of which cannot be forced out of their seating or dismounted from the inside of the door panel.

From the foregoing the necessity of resolving the new technical problem of finding a safety door that can neither be forced or lifted out of its hinges; this because of the impossibility of introducing levers between the hinges or underneath the door itself and because of the impossibility of lifting up the door itself. It must be impossible to remove the lock from its seating by an action from the outside or to dismount it with the door closed from the inside. Furthermore the necessary sturdiness of the panel in order to avoid the breaking or cutting with normal tools and/or equipment, the new door must be sufficiently economical to be used even in average houses, offices, shops and the like.

SUMMARY OF THE INVENTION

This invention resolves the above set out new technical problem completely in a realizable manner by means of the adaption of a transversally sliding door which includes two main parts: one serving as a supporting column equipped with hinges and the other serving as a door body or panel rotatingly supported by the hinges themselves, the supporting column disappearing from view during the opening stage at the inside of a cavity of the fixed works at the side of the hinges, which remain at the outside of the cavity. The edge of the door body opposite to that of the hinges disappearing from view during the closing stage at the inside of another cavity of the fixed works opposite to the one containing the supporting column, the lock being installed in the door body in correspondence to its edge, which is inserted into the inside of the fixed works in such a way that only its lock or, in any case, its opening and closing control members are accessible from the outside and from inside through a slit made in the two bodies of the fixed works delimiting the corresponding cavity towards the outside and towards the inside of the room, the seat of the door being peripherally surrounded by a closed continuous frame recessed in the fixed works, the frame lining completely the walls of the two cavities of the fixed works.

BRIEF DESCRIPTION OF THE DRAWINGS

Just in order to give an indication, some realization of the invention are illustrated in the accompanying six schematic drawings, in which.

DETAILED DESCRIPTION OF THE PREFERRED EMBODIMENTS

Figure 1:
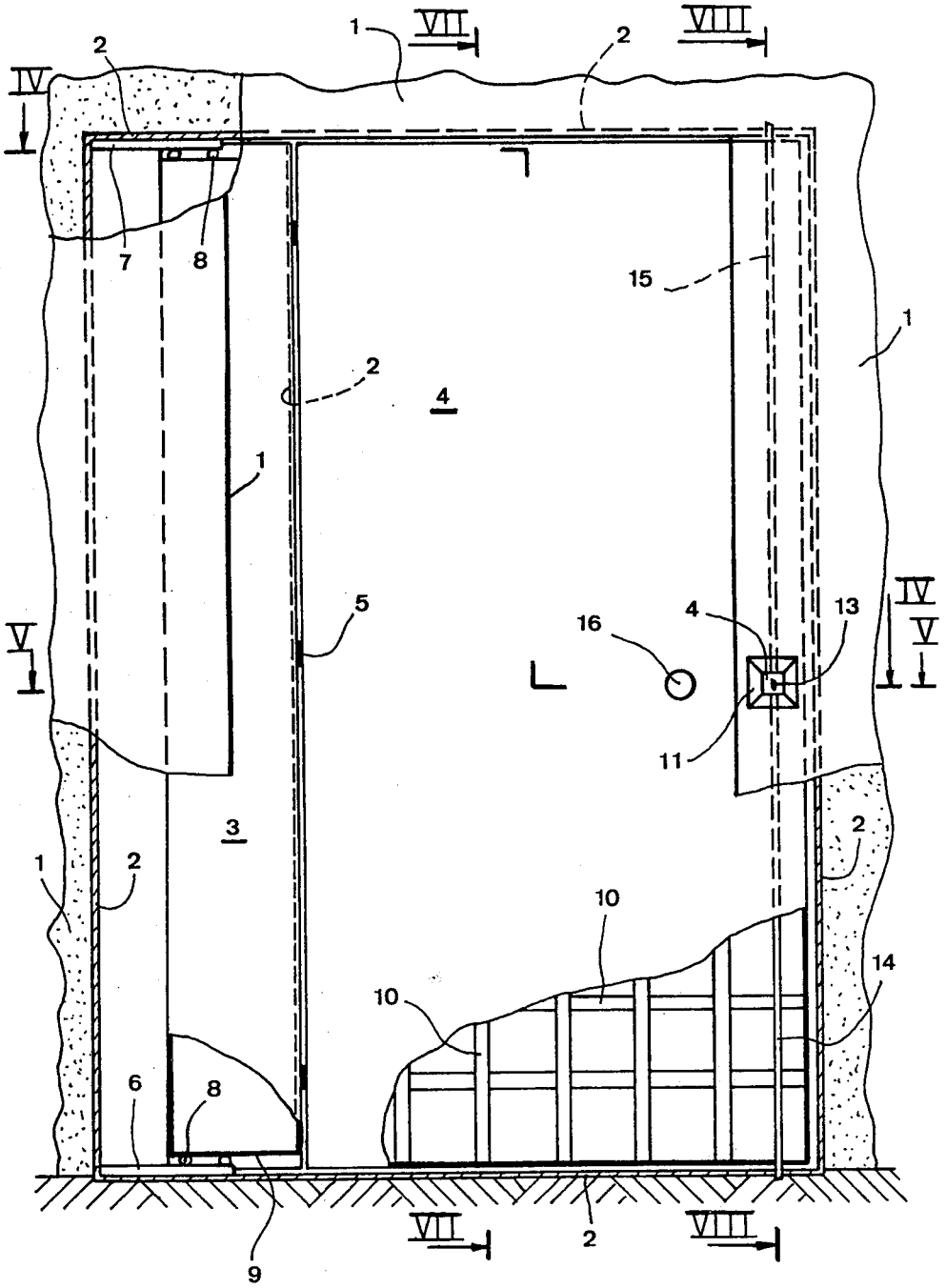
FIG. 1 is a partially cutaway front view of a door according the present invention in a completely closed position.
Figure 2:
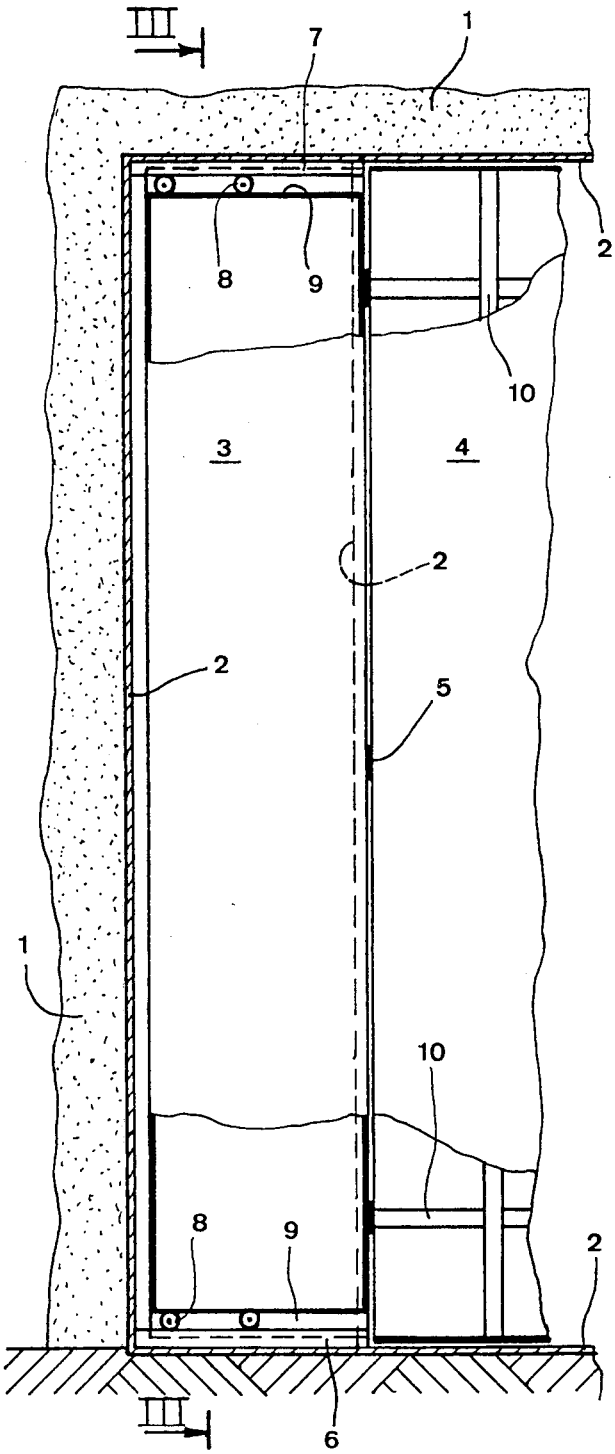
FIG. 2 is a blown up detail of the left part of FIG. 1, blown up and cutaway in order that one may see the supporting column, the body of the door and the corresponding connections.
Figure 3:
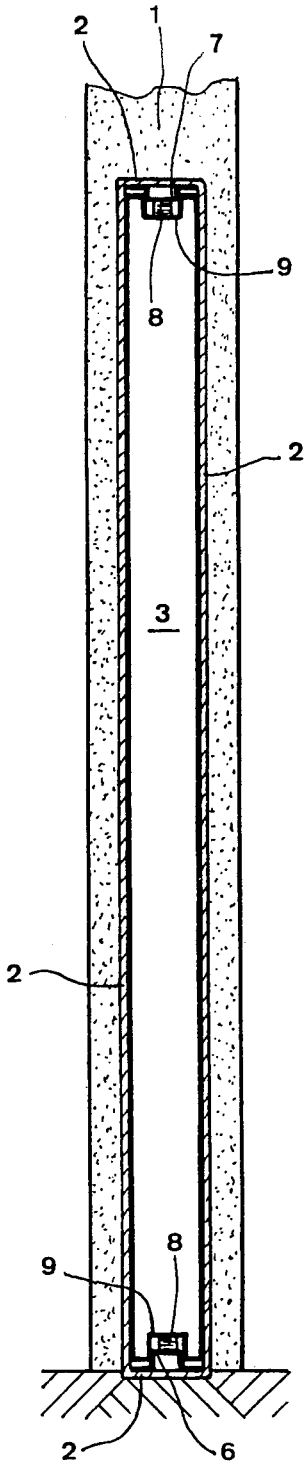
FIG. 3 is the section III—III of FIG. 2.
Figure 4:
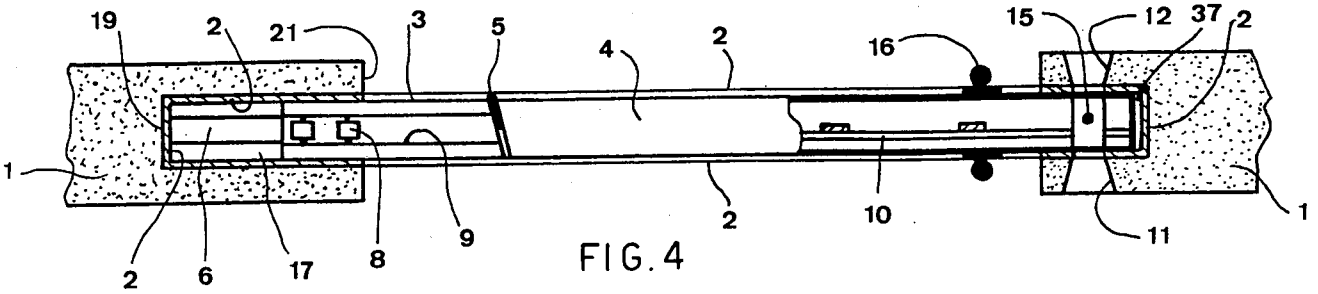
FIG. 4 is the section IV—IV of FIG. 1.
Figure 5:
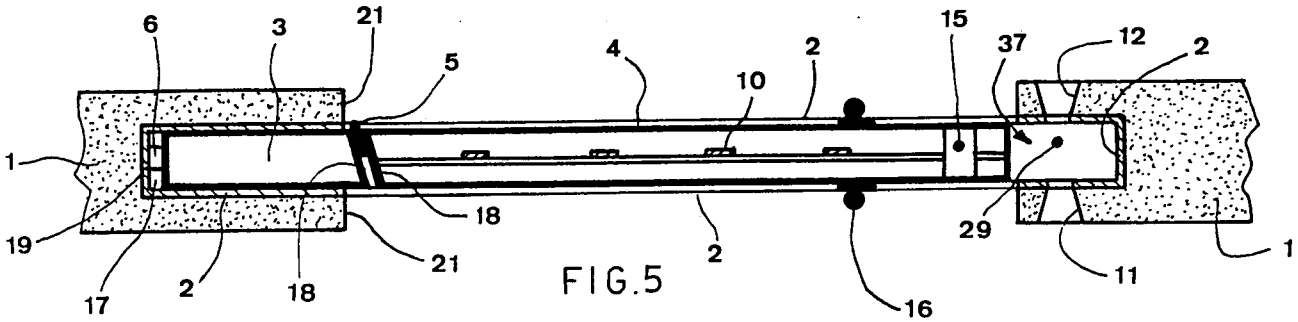
FIG. 5 is the section V—V of FIG. 1.
Figure 6:
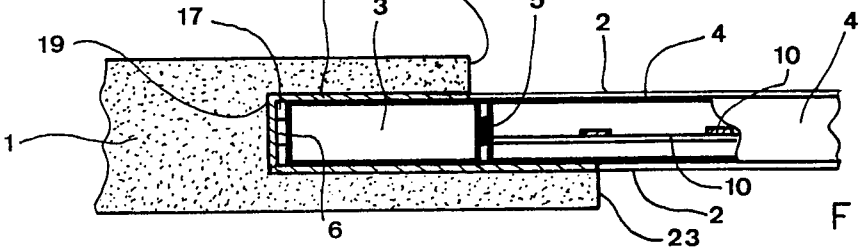
FIG. 6 is a detail of the area of connection between the door body and the corresponding supporting column according to a modified version of the present in invention.
Figure 7:
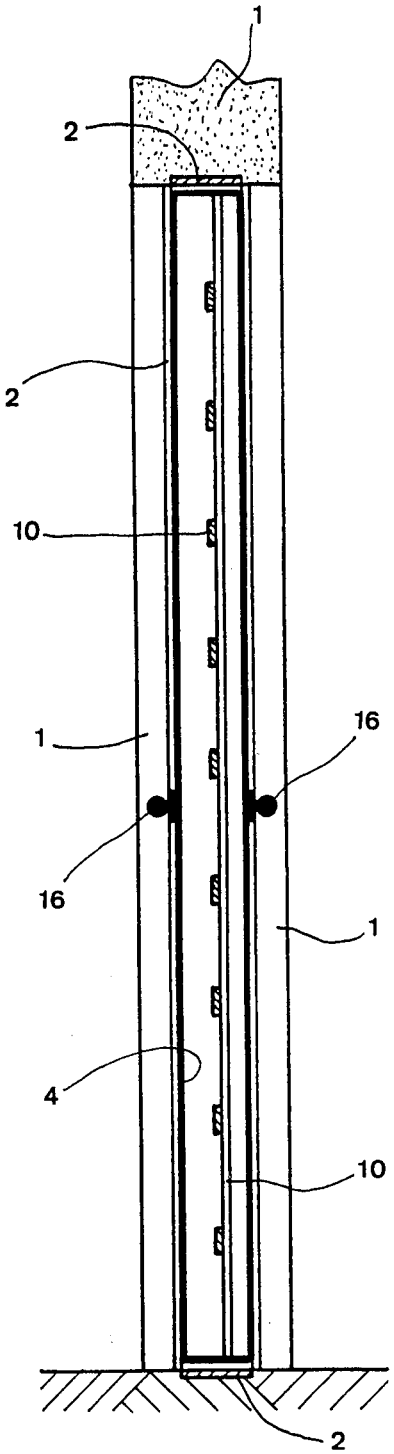
FIG. 7 is the vertical section VII—VII of FIG. 1.
Figure 8:
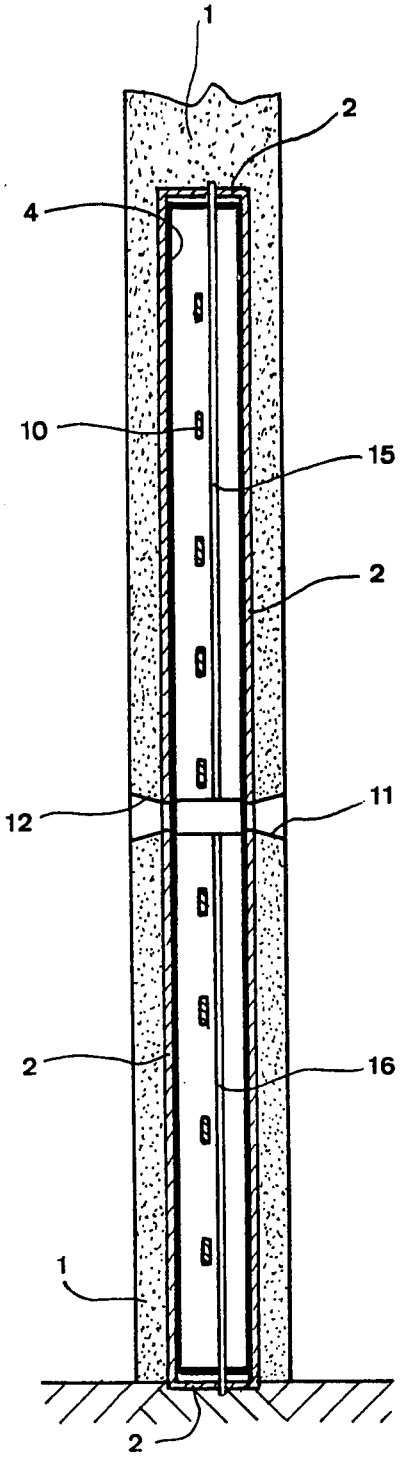
FIG. 8 is the vertical section VIII—VIII of FIG. 1.

The numerals indications are as follows: 1 is the masonry structure or in any case the structure of any type of fixed works delimiting the room to be closed; 2 indicates a continuous peripheral retaining and supporting frame of the whole of the supporting column 3 and the door body 4 coupled to and supported by the column 3 by hinges 5; 6 and 7 indicate respectively a lower and an upper guide fixed to the frame 2 over the length of the supporting column 3 at the inside of the structure 1. The numeral 8 indicates the rolling or sliding members in general, housed in grooves 9 lined with a type of material fit for the longitudinal sliding coupling with that of the guides 6, 7, the grooves being machined in the material of the supporting column 3 and these members being destined to move on the guides 6 and 7; 10 is a possible metal grate serving as reinforcement or safety device in general of the body 4 of the door; 11 and 12 are respectively a slit in the fixed works 1 at the outside and at the inside in order to allow the introduction of the key in the keyhole 13 recessed in the door body 4. The slit 11 is of the shape of a truncated pyramid or truncated cone, tapered towards the lock in order to allow the introduction of the key, limiting the uncovered lock area to a minimum. The numerals 14 and 15 indicate vertical latches that can be operated by a key introduced into the keyhole 13 in order to close the door, the end of the latches penetrating into the corresponding bores made above and below in the frame 2. The numeral 16 indicates the handles to operate the whole of the column 3 and the door body 4; 17 is the cavity or the housing lined by the frame 2, where the supporting column 3 slides; 18 indicates the inclined facing inner edges of the column 3 and the body 4 to make the hinge 5 inaccessible from the outside; 19 is the cavity of structure 1, where the frame 2 is housed. The numeral 21 indicates the sides of the structure delimiting laterally the sides of the cavity 19; 22 and 23 indicate the short and the long side of the structure 1 delimiting laterally the sides of the cavity 19; 24 is a hinged reinforcement and retaining framework, the hinging being brought about by a couple of pins 25 aligned with the pins of the hinges 5, when the door body 4 is in an opening position, at the masonry structure 1 or at the frame 2 fixed to the fixed works 1. The framework is formed by two box type arms, one upper and one lower, bilaterally interconnected in the vertical sense and having C shape sections; 26 indicates a support fixed to the lower end of the framework 24 in order to support the element 27 rolling on the arched guide 28 inserted into the floor. The numeral 29 designates a bore for the latch 14; 30 is a protective and reinforcement lining inserted into a groove machined in the door body 4 in order to allow the housing of the roller 31 or the like in it, which are rolling or sliding on the inner surface of the inferior length of the framework 24. The numeral 32 designates a bearing fixed to the base of the supporting column 3 equipped with a horizontal extension 33 vertically bored in an axis with the above hinges 5 for the coupling at the inside of the fork 34 bored in correspondence, this being a fork, with which the support 35 is equipped, having a C shape section, recessed in a length of the thinned edge of the base of the door body 4; 36 is a pin of the hinge coupled with the bores of the extension 33 and of the fork 34; 37 (FIGS. 4, 5, 6, 11) indicates another cavity lined by the frame 2 on the opposite side of the cavity 17 for the sliding of the edge of the door body 4 opposite to the one connected with the supporting column 3.

The operation takes place in the following manner: in the case of the version of the FIG. 1, where the door body is supported by the supporting column 3 only by the hinges 5, the opening of the door after the introduction of the key in the keyhole 13 through one of the slits 11 and 12 made in the masonry works 1 is made by the sliding of the whole towards the side opposite to that of the lock for a distance sufficient for the extraction of the edge of the door body 4 from the cavity 37 of the frame 22, which penetrates into the masonry, where the slits 11 and 12 are machined; the sliding of the whole determinating (FIG. 5) the complete re-entering of the supporting column 3 into the cavity 17 delimited by that part of the frame 2, which is recessed in the masonry located at the side opposite to the one where the slits 11 and 12 are situated; thus determinating the possibility of rotating the door body 4 on the hinges 5 in order to throw the door wide open. This applies anologously for the other illustrated variants of the door.

Figure 10:
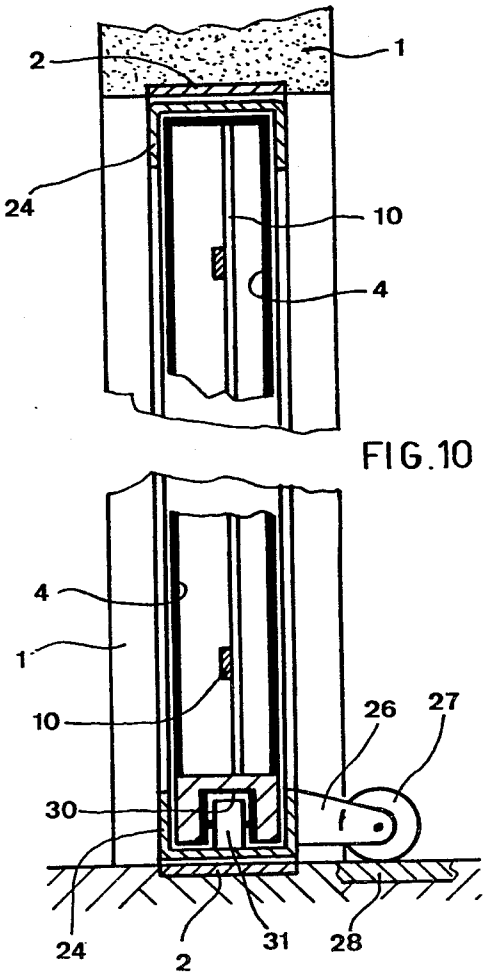
FIG. 10 is the section X—X, blown up and interrupted, of FIG. 9.
Figure 9:
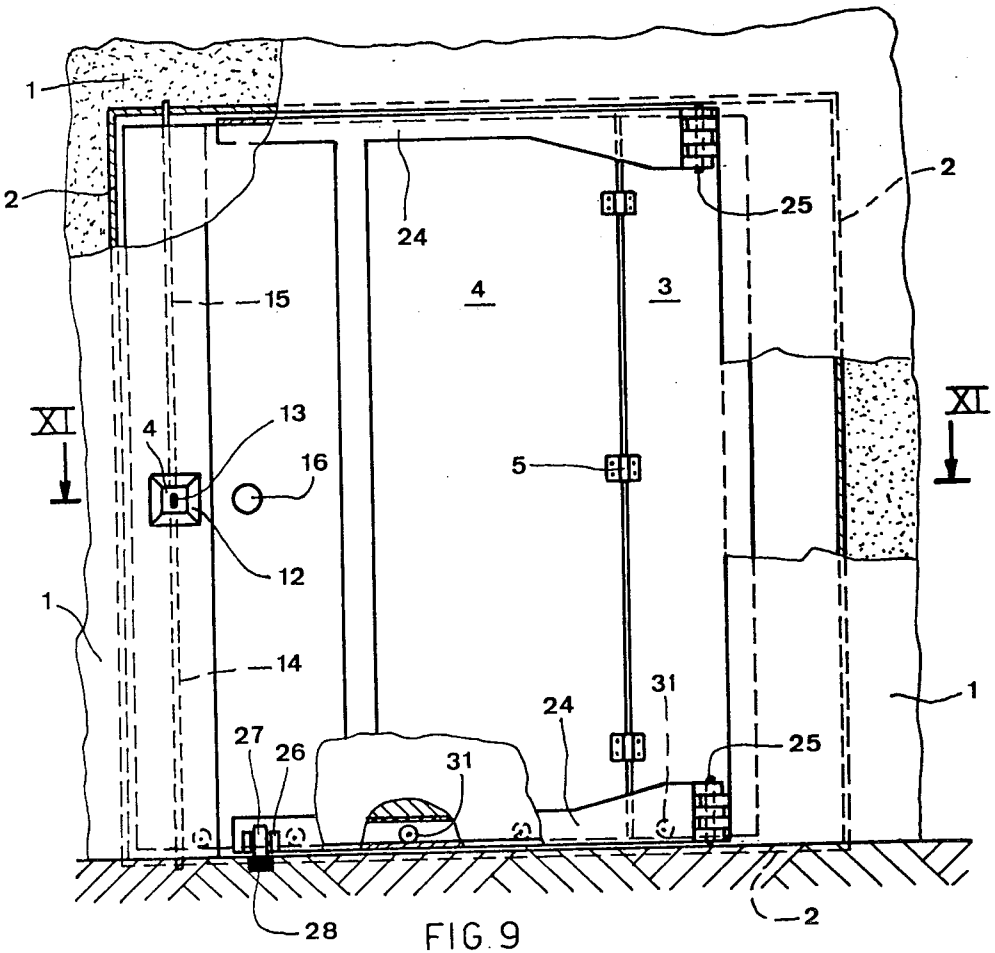
FIG. 9 is the front view of a closed gate equipped with a reinforcement frame and an arched rolling guide serving as a support for the gate itself during the opening and closing operations.
Figure 11:
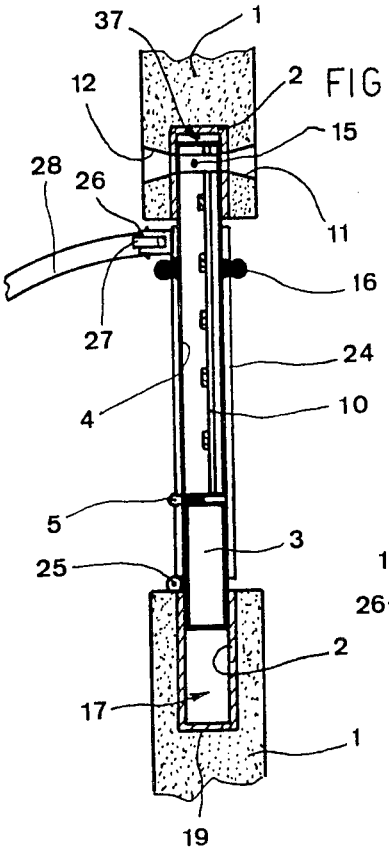
FIG. 11 is the section XI—XI of FIG. 9.
Figure 12:
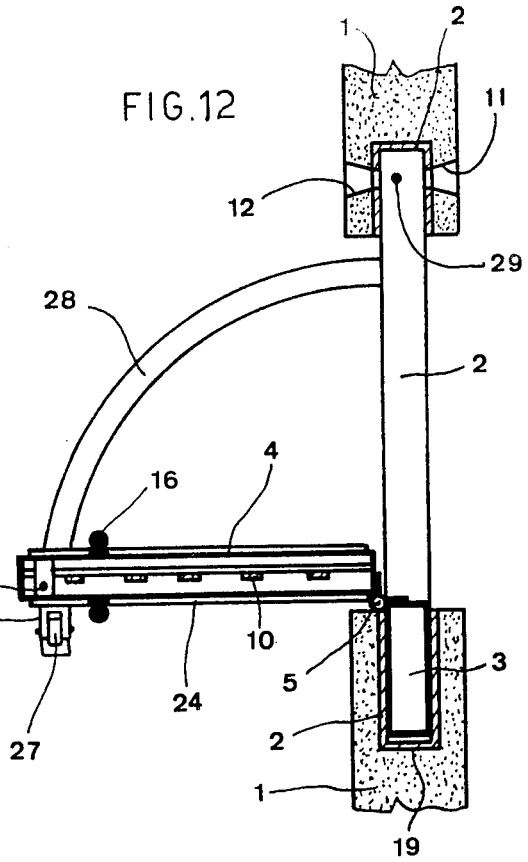
FIG. 12 is a section like the one of FIG. 11, but with the door in an open position.
Figure 13:
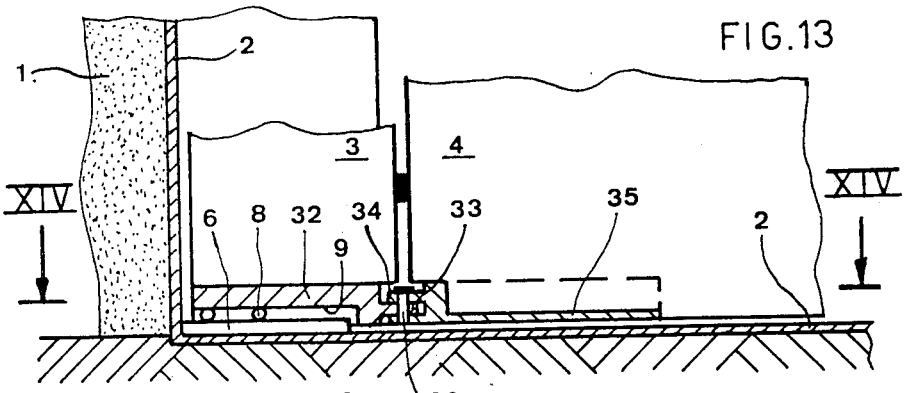
FIG. 13 is a partially cutaway and interrupted detail in elevation of an ancillary support device of the body of the door at the supporting column.
Figure 14:
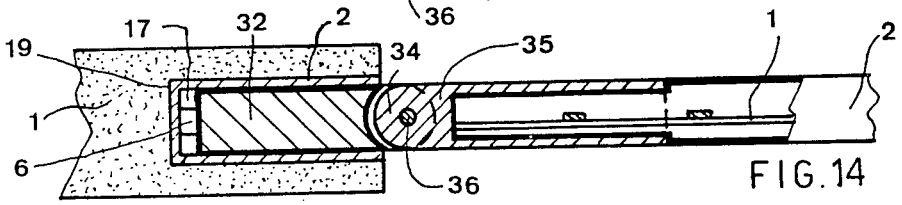
FIG. 14 is the section XIV—XIV of FIG. 13.

In the variants of the FIGS. 9–10 the vertical axis of the hinges 5 align themselves with that of the hinges 25 of the framework 24 in order to allow the sliding of the whole of 3–4 during the opening stage of the door; this in such a way as to allow the rotation of the whole of the door body 4 and of the corresponding reinforcement framework 24.

In the practical realization the materials, the dimensions and the execution details can be different from those indicated, being technically equivalent without departive from the scope of this invention.

Thus, for instance, the supporting columns 3 and the door bodies 4 might in any case be formed according to their use as doors or gates of buildings or of movable structures such as motorcars or even safes.

I claim:

1. A safety door assembly for buildings and rooms in general, the assembly comprising fixed works (1); a door including two main transversely sliding parts (3, 4), one of said parts being a supporting column (3) of given width and the other of said parts being a door body (4) which is much wider than said given width of said column; hinge means (5) between a first edge of said column and a first edge of said door body for supporting said door body for movement about an axis defined by said hinge means; a first recess (17) in said fixed works along a side thereof into which said supporting column substantially disappears during opening, said hinge means remaining outside said first recess during opening; a second recess (37) in said fixed works opposite said first recess; lock means including operating means installed in said door body in vicinity of an edge thereof opposite said hinge means, said lock means substantially disappearing into said second recess during closing; respective openings (11, 12) on opposite side of said fixed works opening into said second recess for allowing access to said operating means of said lock means from inside and outside when said door body is in said second recess while preventing access to said lock means; respective grooves (9) along upper and lower edges of said supporting column (3); respective fixed guide (6, 7) adjacent said grooves (9); and rolling, or sliding means (8) received in said grooves and movable therein.

2. A safety door assembly according to claim 1, including a closed continuous frame (2) recessed in the fixed works (1) said frame lining completely walls of said first and second cavities (17, 37) and being bored in correspondence to ends of vertical latches (14, 15) for their introduction, said latches being parts of said lock means.

3. A safety door assembly according to claim 2, including reinforcing cement and protection lining on sides of said grooves, and wherein said supporting column (3) is above and below equipped with respective said grooves (9) to receive said rolling or sliding means (8) destined to move on corresponding said guides (6, 7) fixed to said frame (2) over a length defined within inside of a respective corresponding additional cavity (19) in said fixed works each said guide penetrating into a respective said groove to couple in a longitudinally sliding manner with said lining of said grooves.

4. A safety door assembly according to claim 1 or 2 wherein said respective openings (11, 12) are respective slits in said fixed works and said operating means is a keyhole (13), said keyhole being tapered to a truncated pyramid or truncated cone shape towards said lock means.

5. A safety door assembly according to claim 1, wherein facing edges (18) of said supporting column (3) and of said door body (4) are inclined with respect to the direction of the axis of the opening of the door, said hinge means (5) being arranged along an inner side of said door body.

6. A safety door assembly according to claim 1 or 2 wherein said fixed works (1) delimits sideways said first recess (17), where said supporting column (3) slides, and has a longside (23), at the outside of the assembly door which covers the area of said hinge means (5), thus reducing the outer opening of the door assembly compared to the inner one.

7. A safety door assembly according to claim 1, including a reinforcement structure (24) hinged to said fixed works (1) in two upper and lower angle areas of the door opening at the side of said supporting column (3), this reinforcement structure including a couple of opposed box type arms, having a C-shape section and embracing upper and lower edges of the door body (4) bilaterally interconnected in a vertical sense during rotation of said door body (4), said hinges mean (5), which unite said door body with said supporting column (3), being aligned vertically with pins (25) of said reinforcement structure (24).

8. A safety door assembly according to claim 2, including a reinforcement structure (24) hinged to said continuous frame (2) surrounding the seat of the door assembly in two upper and lower angle areas of the door opening at the side of said supporting column (3) this reinforcement structure including a couple of opposed box type arms, having a C-shape section and embracing upper and lower edges of the door body (4) bilaterally interconnected in a vertical sense during rotation of said door body (4), said hinge means (5), which unite said door body with said supporting column (3), being aligned vertically with pins (25) of said reinforcement structure (24).

9. A safety door assembly according to claim 7 or 8, including a groove in a lower edge of said door body (4), this groove being equipped with a protection and reinforcement lining (30) for the insertion of rolling or sliding bodes (31) which are to move on the bottom of said C-shape section of the lower arm of said reinforcement structure (24).

10. A safety door assembly according to claim 9, wherein towards a free end of said lower arm of said reinforcement structure (24) there is fixed a support (26) of at least one rolling or sliding body (27) which is to move on an arched guide (28) during rotating opening of said door body (4).

11. A safety door assembly according to claim 1 or 2, wherein said supporting column (3) and said door body (4) have respective bases, and said base of said supporting column, as well as at said base of said door body (4) over its length adjacent to said column are provided with respective extensions (32, 35) a lower surface of each extension being coplanar with the lower limit of the door assembly, itself, and extending across an area below said hinge means (5) in order to establish a fork insertion (34) coupling through a vertical hinge pin (36), vertically aligned with a pin of hinges constituting said hinge means.

12. A safety door assembly according to claim 11, base of said supporting column (3) is in its lower portion equipped with one of said grooves (9) for receiving at least some of said rolling or sliding bodies (8) which are to move on one of said guides (6) projecting from a frame member which is recessed in said fixed works, this said guide penetrating from a lower portion into this said groove.

13. A safety door assembly according to claim 11, wherein said extension (35) of said base of said door body (4) has a C-shape section open towards an upper portion thereof in order to receive a length of a lower edge of said door body (4) which is of corresponding width so as to fit into said section.

* * * * *